United States Patent [19]

Kawata et al.

[11] Patent Number: 5,023,853

[45] Date of Patent: Jun. 11, 1991

[54] ELECTRIC APPARATUS WITH SILENT ALARM

[76] Inventors: Masayuki Kawata; Nobuo Tsukada, both of 31-1, Kameido 6-chome, Koto-Ku Tokyo, Japan

[21] Appl. No.: 369,732

[22] Filed: Jun. 22, 1989

[30] Foreign Application Priority Data

Jun. 27, 1988 [JP] Japan ..... 63-85405[U]
Feb. 13, 1989 [JP] Japan ..... 1-15692[U]

[51] Int. Cl.[5] ..... G04B 19/06; G04C 21/00

[52] U.S. Cl. ..... 368/230; 368/250; 368/255; 310/316

[58] Field of Search ..... 368/72–74, 368/230, 250, 251, 255; 310/316, 317, 322, 323, 526, 525

[56] References Cited

U.S. PATENT DOCUMENTS 4,456,387 6/1984 Igarashi ..... 368/230
4,723,085 2/1988 Mukohjima et al. ..... 310/328
4,727,276 2/1988 Izukawa et al. ..... 310/316
4,829,209 5/1989 Kawasaki et al. ..... 310/317
4,833,359 5/1989 Tanoue et al. ..... 310/316

*Primary Examiner*—Vit W. Miska
*Attorney, Agent, or Firm*—Bruce L. Adams; Van C. Wilks

[57] ABSTRACT

A timepiece in which a vibration member starts vibration at an alarm time to let a person know the alarm time. The timepiece comprises a case having a shape of thin, small-sized wrist watch form, timekeeping circuit for counting a present time, alarm circuit for setting alarm time, detection circuit for detecting a coincidence a present time with the alarm time and the vibration member actuated at a set time to indicate time. The vibration member comprises a ultrasonic wave motor and an eccentric weight wheel driven by the ultrasonic motor and having its center of gravity deviated from its axis. The whole timepiece is vibrated by the unbalanced centrifugal forces produced by the turn of the weight wheel at the set time to indicate the time.

11 Claims, 8 Drawing Sheets

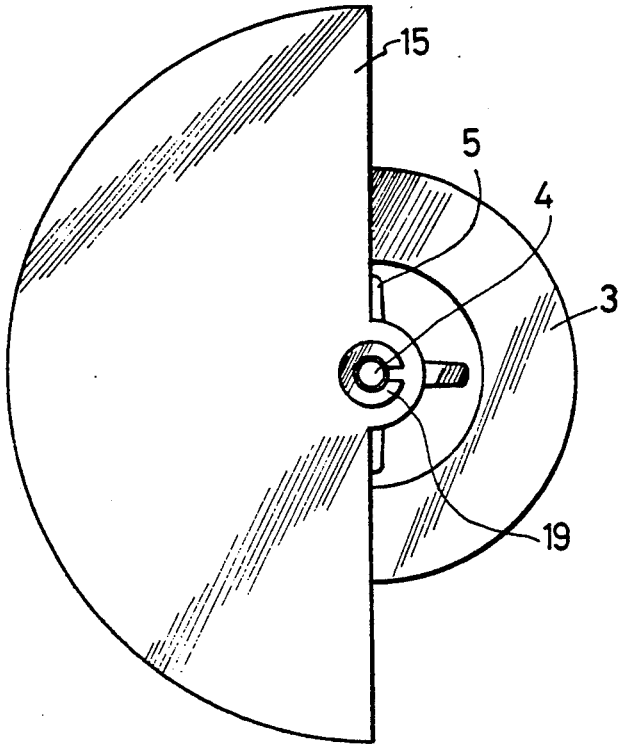
FIG. 6
FIG. 7
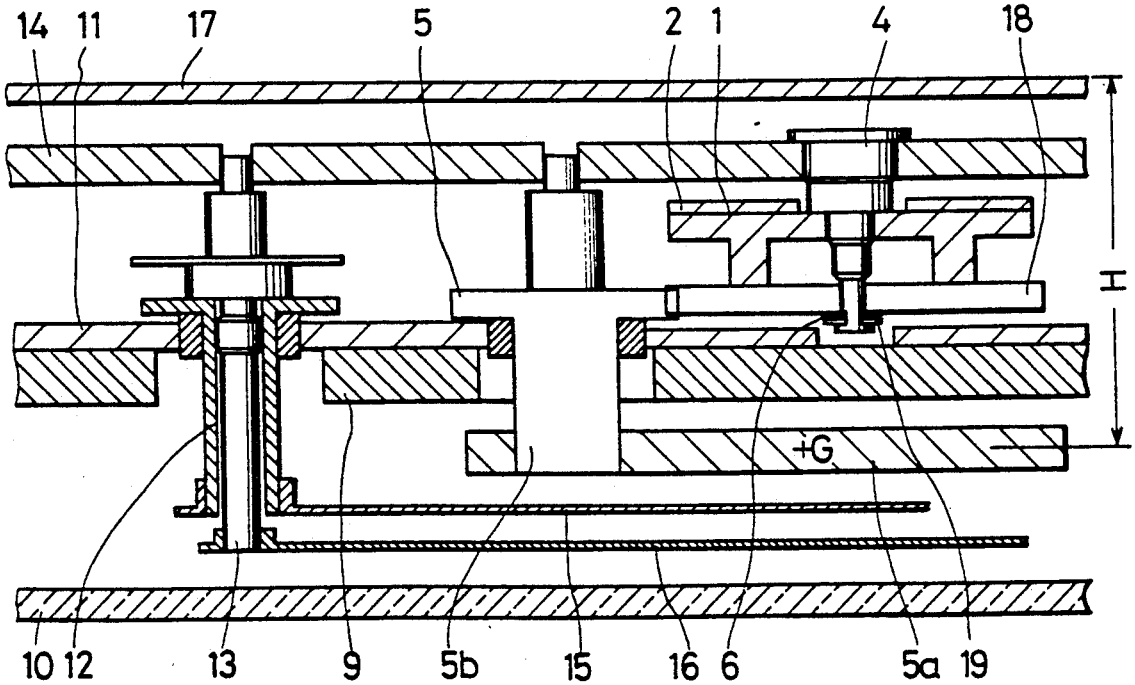

ELECTRIC APPARATUS WITH SILENT ALARM

BACKGROUND OF THE INVENTION

This invention relates to an electric apparatus having a silent alarm function, and more particularly to an electric apparatus with silent alarm which generates a vibration at an alarm time.

A silent alarm is sometime employed in a timepiece or pager. A conventional clock with silent alarm is shown in FIG. 14. A vibration alarm 27, which often sets under a pillow, holds a vibration alarm motor 28 that has an eccentric weight 29 on the rotary shaft and that is electrically connected to a clock 25 through a connection cord 26. The vibration alarm motor 28 rotates at an alarm set point time, and the vibration alarm 27 is vibrated by the centrifugal force of the eccentric weight 29 generated by the turn thereof to let a person know the alarm time.

On the other hand, a variety of wrist watches with silent alarm have heretofore been proposed of a type in which a bar, a hammering piece or a lever gives stimulation to the skin to let a person know a set point time. Furthermore, Japanese Utility Model Laid-Open No. 188185/1982 discloses a wrist watch of the vibration type in which a hammering bar 30 is actuated by a gear 33 and the like and an impact receiving piece 32 directly coupled to a vibration plate 31 is knocked repetitively to generate vibration which stimulates the skin to let a person know a set point time.

The system which generates vibration by rotating the eccentric weight has been employed for clocks and pocket bells that have relatively large sizes as described above. However, such a system has not been adapted to the wrist watches yet, and a concrete structure therefor has not been proposed, either, since the alarm motor for generating the vibration becomes bulky and extra space is required for the eccentric weight, Among the conventional wrist watches with silent alarm, those of the type which stimulates the skin by a bar, a hammering piece or a level encounter limitations in the outer structure, lack general applicability, and are liable to lose water-proof capability. Furthermore, the wrist watches which stimulate the skin give an uncomfortable feeling to the person wearing them. Further, the device of the type of vibration shown in FIG. 15 is fundamentally the same as the system that gives stimulation by a bar or the like; i.e., stimulation is given repetitively very many times maintaining short intervals, and problems the same as those mentioned above are involved. In this case, furthermore, the hammering bar continuously knocks the impact receiving piece, whereby a knocking noise is generated which is not a silent alarm and the durability is deteriorated. Moreover, an increased number of parts is disadvantageous for realizing the wrist watch with silent alarm in a small size and in a reduced thickness.

SUMMARY OF THE INVENTION

It is therefore an object of the invention to provide an electric silent alarm apparatus in a small size and in a reduced thickness in which vibration is generated at an alarm time.

It is another object of the invention to provide an electronic silent alarm of the type of highly efficient vibration as much as possible with a small amount of drive energy.

It is further object of the invention to provide an electric silent alarm in which the alarm is visually informed.

These and other objects of the invention are accomplished by an electric silent alarm apparatus comprising a case capable of being held on the palm of a hand, timecounting means in the case for counting a present time, alarm time setting means for setting an alarm time in response to a user operation an, ultrasonic motor in the case having an eccentric weight for generating vibration, alarm time detection means for detecting coincidence of a present time with the alarm time set by the alarm time setting means, and driving means for driving the ultrasonic motor in accordance with the detection of the coincidence.

The case may have a shape of a wrist watch.

The case may include a pin therein and the ultrasonic motor includes a vibrator supported by the pin having a piezoelectric element bonded thereon for generating a surface wave thereon, and an eccentric weight wheel having its center of gravity deviated from its rotational axis and driven with the surface wave.

The case may include a main plate therein and the pin is fixed in the main plate.

The eccentric weight wheel may be supported by the pin.

The eccentric weight wheel may be in contact with the vibrator.

The apparatus may include pressurizing means for urging the eccentric weight wheel against the vibrator.

The apparatus may include a rotor in contact with the vibrator and rotated by the surface wave.

The eccentric weight may be rotated by the rotor.

The eccentric weight wheel may be disposed toward a glass and the vibrator of the ultrasonic motor may be disposed toward a back cover.

A portion of the eccentric weight may be exposed through a display portion.

According to the above-mentioned constitution, the ultrasonic wave motor is rotated to turn the eccentric weight and the whole apparatus is vibrated to inform the alarm.

BRIEF DESCRIPTION OF DRAWINGS

FIG. 6 is a plane view of a weight portion in FIG. 5.

FIG. 7 is a section view of a wrist watch with silent alarm according to another embodiment of the invention.

DETAIL DESCRIPTION OF PREFERRED EMBODIMENTS

Figure 1:
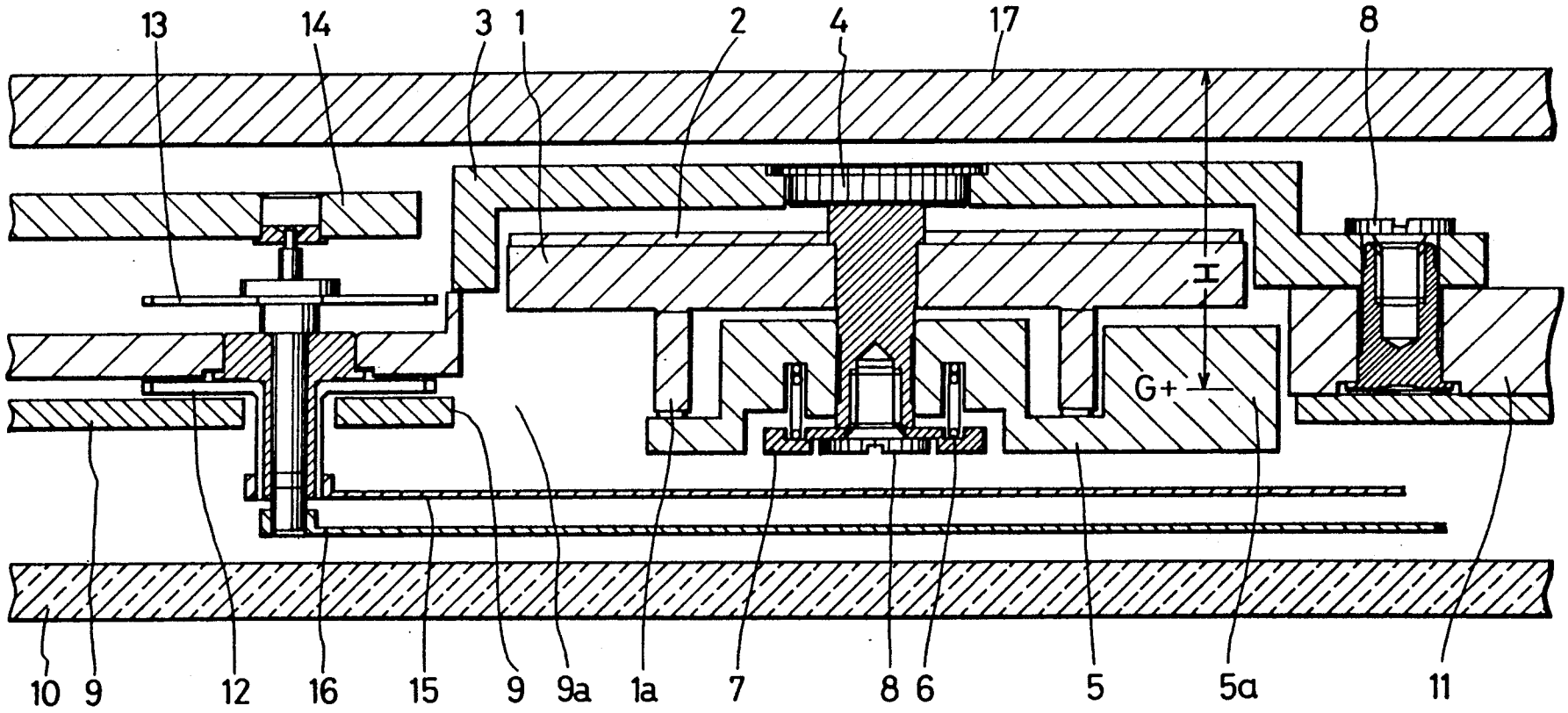
FIG. 1 is a section view of a wrist watch with silent alarm according to the invention

In FIG. 1, a vibrator 1 has a piezoelectric element 2 adhered thereon and is supported by a pin 4 that is provided on a vibrator support plate 3. An eccentric weight wheel 5 rotates about the pin 4 as a center and has a semi-circular arcuate eccentric weight portion 5*a* along the outside of comb teeth 1*a* of the vibrator 1. The eccentric weight wheel 5 is brought into pressed contact with the comb teeth 1*a* of the vibrator 1 by a pressurizing spring 6, a holding washer 7 and a screw 8, and works as a rotor of an ultrasonic wave motor.

Figure 2:
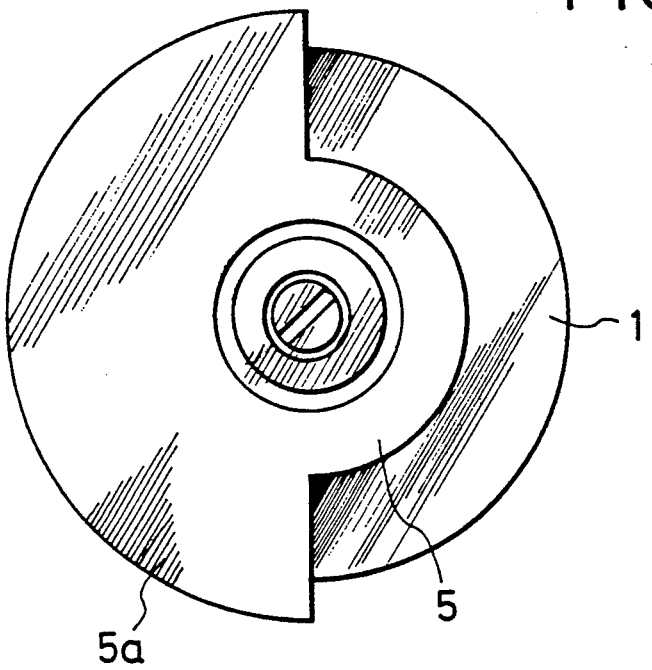
FIG. 2 is a plane view of a weight portion in FIG. 1.
Figure 3:
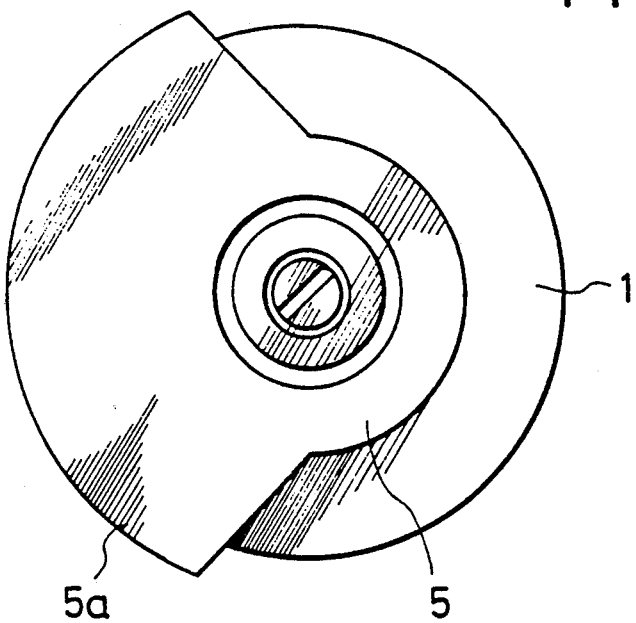
FIG. 3 is a plane view of another embodiment of a weight portion in FIG. 1.

FIG. 2 shows a plane view of the eccentric weight wheel 5. The eccentric weight wheel has a shape of a semi-circular sector. Another eccentric weight wheel is described in FIG. 3. In this embodiment, the eccentric weight wheel has a shape of a fan to produce the same effects as those of the semi-circular weight.

Returning to FIG. 1, the eccentric weight wheel 5 penetrates through a hole 9*a* formed in the dial 9 and protrudes toward a glass 10. The vibrator support plate 3 is secured to a main plate 11 by the screw 8. An hour wheel 12 and a minute wheel 13 are supported by the main plate 11 and by a train wheel bridge 14, and mount an hour hand 15 and a minute hand 16, respectively. A back cover 17 is the same as that of ordinary timepieces.

Figure 4:
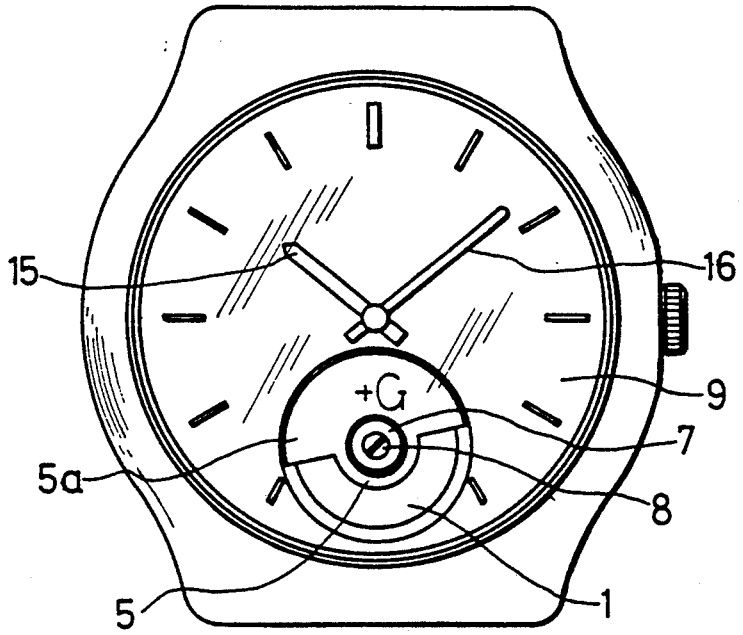
FIG. 4 is a diagram showing the appearance of the wrist watch with silent alarm according to the invention.

FIG. 4 shows an external view of the wrist watch with silent alarm according to this invention. The dial plate 9 has a view window in the lower portion thereof. The eccentric weight wheel 5 is located in the window and viewed through it.

Described below is the operation. When an electric signal is applied to the piezoelectric element 2, the vibrator 1 undergoes mechanical vibration which causes the eccentric weight wheel 5 to rotate. Therefore, the center of gravity (point denoted by G) which is positioned deviated from the axis of rotation undergoes a motion, whereby the whole wrist watch is vibrated by the reaction and the energy of vibration is given to the wrist to let a person know the alarm. Here, the wrist watch is vibrated by the rotation of the eccentric weight wheel 5. The back cover 17 which is in contact with the wrist is on the fixed side and a large amplitude is produced toward the direction of the glass. Therefore, the moment for producing vibration becomes great toward the direction of the glass 10 with the increase in the distance between the eccentric weight wheel 5 and the back cover 17. When a distance between the back cover and the center of gravity of the eccentric weight is denoted by h in the case when the eccentric weight is contained in the movement and the distance in the case of this device is denoted by H, there holds a relation $H >> h$, and vibration is generated efficiently.

The embodiment of this device uses an ultrasonic wave motor as a drive source which is constituted by stacking plate-like members in contrast with an ordinary cylindrical electromagnetic motor. The ultrasonic wave motor therefore has such a reduced thickness that the wrist watch itself can be realized in a reduced thickness. Furthermore, the ratio H/h becomes great enabling the vibration efficiency to be improved. However, the drive source need not be limited to the ultrasonic motor only but may be an ordinary electromagnetic motor to provide the same effect of bringing the weight close to the dial. The motion of the eccentric weight wheel 5 can not be seen from the external side when it is contained in the movement. As shown in FIGS. 1 and 4, however, the motion of the eccentric weight wheel 5 can be seen directly if it is located on the front side of the dial 9. The alarm therefore can be informed visually in addition to being informed in the form of vibration.

Figure 5:
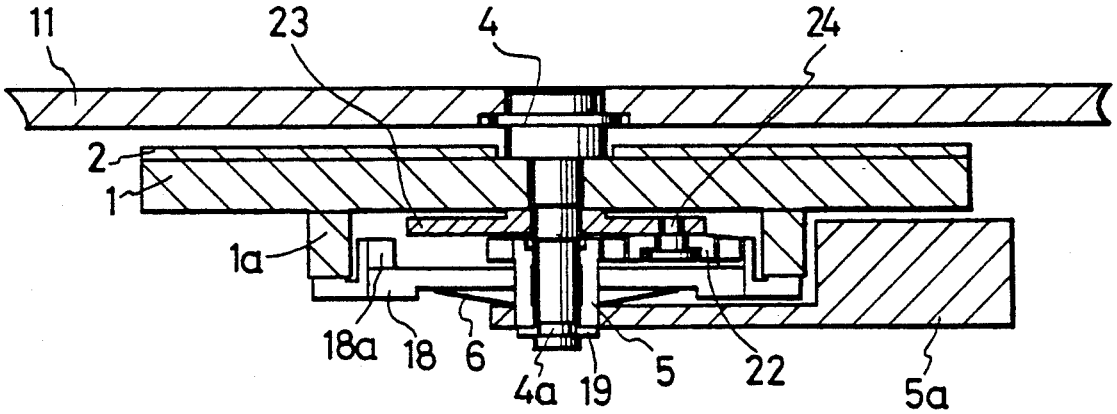
FIG. 5 is a section view of a wrist watch with silent alarm according to another embodiment of the invention.

FIGS. 5 and 6 illustrate another embodiment of this device wherein the pin 4 is driven into the main plate 11 and is secured thereby, the vibrator 1 on which the piezoelectric element 2 is adhered is secured by the pin 4, a transmission wheel receiver 23 which rotatably supports a transmission wheel 22 by a wheel guide pin 24 is fitted to the pin 4 in order to rotatably support the rotor 18 having a gear portion 18*a* that engages with the transmission wheel 22, the rotor 24 is supported by the pressurizing spring 6 that is brought into pressed contact with the comb-toothed portion 1*a* of the vibrator 1, the pin 4 rotatably supports a weight wheel 5 that has a gear engaging with the transmission wheel 22 and that has a center of gravity deviated from the center thereof, and the fixing spring is driven into the fixing groove 4*a* of the support pin 4 to secure the weight wheel.

The operation will be described next.

When the alarm is to be operated, the piezoelectric element 2 is vibrated due to an electric current that flows thereto. The vibration that is generated is then transmitted to the vibrator 1 and is amplified by the comb-toothed portion 1*a*. The rotor 18 is rotated by the comb-toothed portion 1*a* with the support pin 4 as a center of rotation, and the transmission wheel 22 is rotated by a gear formed on the rotor 18. The transmission wheel 22 causes the weight wheel 5 having a center of gravity deviated from the center thereof to rotate with the pin 4 as a center of rotation. The unbalanced centrifugal force produced by the turn of the weight wheel 5 is transmitted through the main plate 11 to vibrate the whole timepiece.

Even when the timepiece has an increased weight as a whole, the wheel train in this case increases the speed of rotation; i.e., the number of revolutions of the weight wheel 5 is increased and the unbalanced centrifugal force can be increased.

Figure 8:
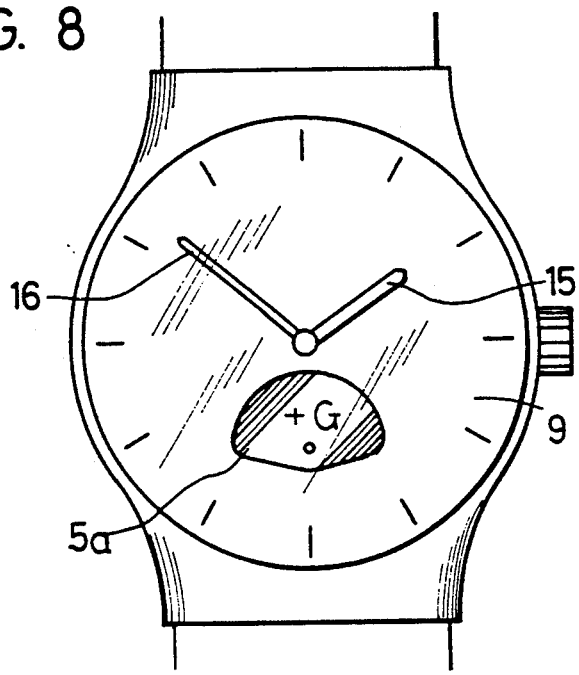
FIG. 8 is a diagram showing the appearance of the wrist watch with silent alarm in FIG. 7.

Another embodiment will be described next in conjunction with FIGS. 7 and 8. The vibrator 1 on which the piezoelectric element 2 is adhered is supported by the pin 4 that is provided on the train wheel bridge 14. The rotor 18 is in the form of a disk without eccentric weight and is brought into pressed contact with the vibrator 1 by a pressurizing spring 6 and a stop ring 19. A gear is formed along the periphery of the rotor 18 and is in mesh with the eccentric weight wheel 5 that is provided by a shaft separately form the pin 4. The eccentric weight wheel 5 is supported by the main plate 11 and by the train wheel bridge 14, a shaft portion 5*b* thereof protrudes to the front side penetrating through the dial 9, and to the tip thereof is secured an eccentric weight 5*a* that has a center of gravity at a point G. In other respects, the device is the same as that of FIGS. 1 and 2. In this case, the effects are obtained which are the same as those of the case of FIG. 1 without the need of forming in the dial 9 a hole greater than the eccentric weight 5*a* but only the shaft portion 5*b* need fit through the dial 9. Therefore, the dial 9 is deformed little and can be easily machined providing better appearance. Furthermore, the revolution is transmitted at an increased speed via gears, making it possible to generate stronger vibration.

Figure 9:
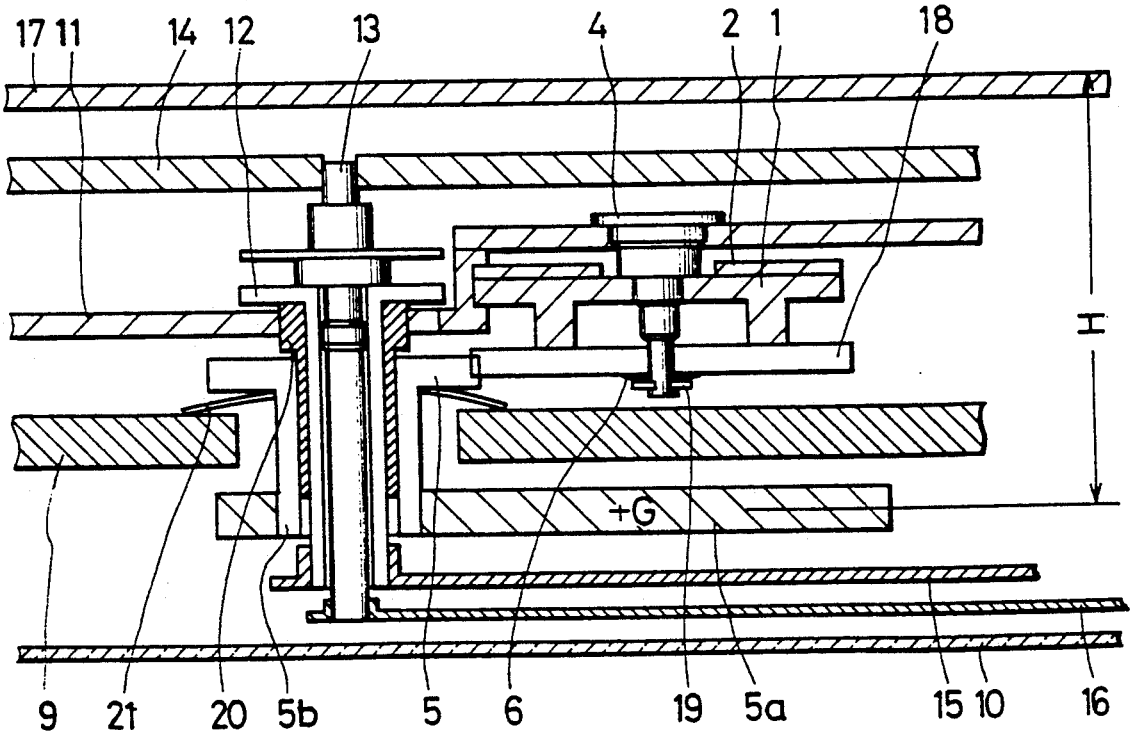
FIG. 9 is a section view of a wrist watch with silent alarm according to another embodiment of the invention.
Figure 10:
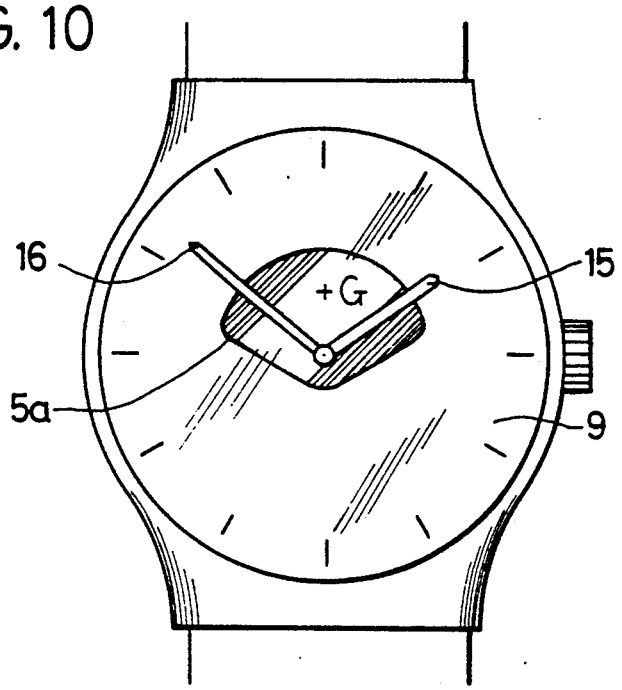
FIG. 10 is a diagram showing the appearance of the wrist watch with silent alarm in FIG. 9.

FIGS. 9 and 10 illustrate a further embodiment. The hour wheel 12 and the minute wheel 13 are supported by the main plate 11 and by the train wheel bridge 14, and the hour hand 15 and the minute hand 16 are driven to indicate the time. The pin 4 is driven into the back of the main plate 11 to support the vibrator 1 on which the piezoelectric element 2 is adhered and to guide the rotor 18. The pressurizing spring 6 and the stop ring 19 are incorporated under the rotor 18 to bring the rotor 18 into pressed contact with the vibrator 1. A gear is formed along the circumference of the rotor 18 and is in mesh with the eccentric weight wheel 5. The eccentric weight wheel 5 is guided by a center pipe 20 provided on the main plate 11, and is held between the main plate 11 and the dial 9 via a dial washer 21. The eccentric weight wheel 5 has a cylindrical portion 5*b* that protrudes onto the front side penetrating through the dial 9 and has at the tip thereof an eccentric weight 5*a* that has a center of gravity at a point G. The back cover 17 and the glass 10 are constituted in the same manner as those of the ordinary wristwatches.

Even in this case, the effects are exhibited which are the same as those of the case of FIG. 1. However, since the eccentric weight wheel 5 is provided concentric with a hand wheel at the center of the movement, the watch presents orthodox appearance.

Figure 11:
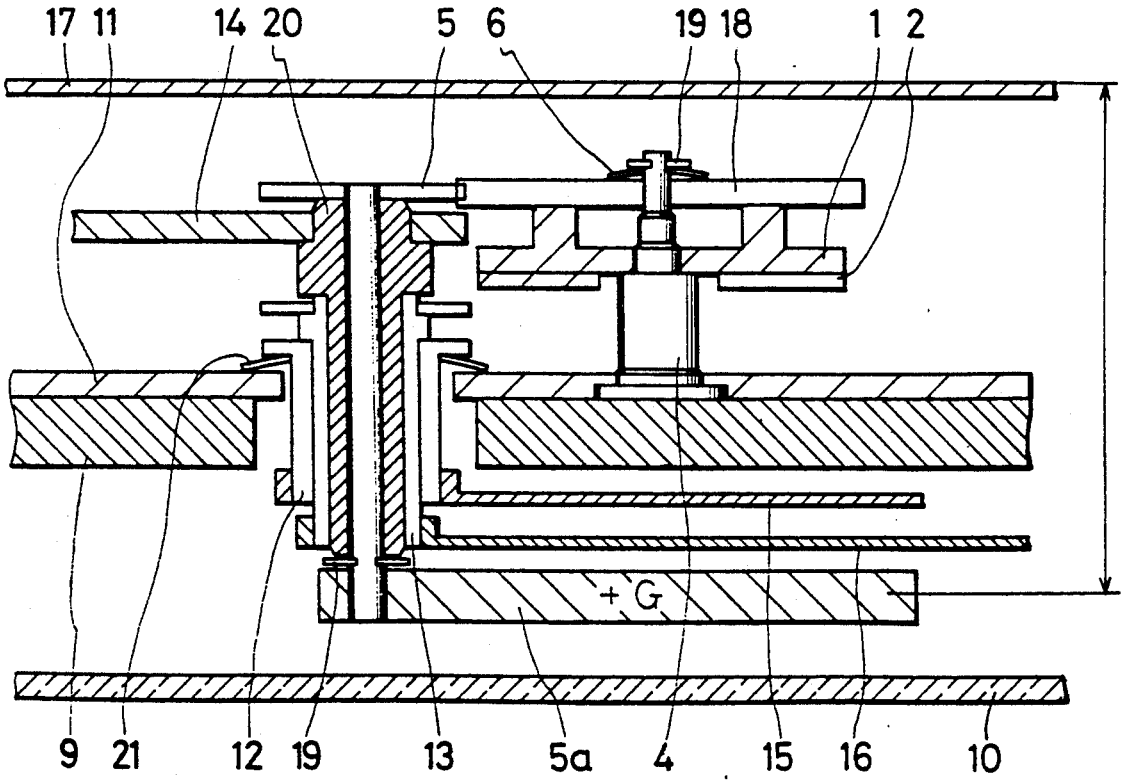
FIG. 11 is a section view of a wrist watch with silent alarm according to another embodiment of the invention.

Next, FIG. 11 illustrates a still further embodiment. A center pipe 20 is provided in the train wheel bridge 14, and the minute wheel 13 and the hour wheel 12 that are guided along their peripheries are held between the train wheel bridge 14 and the main plate 11 via the dial washer 21. The eccentric weight wheel 5 is guided along the inner periphery of the center pipe 20 and is supported by the stop ring 19. The pin 4 is driven into the main plate 11 on the upper side thereof to support the vibrator 1 and to guide the rotor 18. The rotor 18 and the eccentric weight wheel 5 are in mesh with each other via gears that are formed along the circumferences thereof. In other respects, the watch is the same as that of FIG. 5. Even in this case, the effects are exhibited which are the same as those of the case of FIG. 5. The hour hand 15, the minute hand 16 and the eccentric weight 5*a* are exchanged for their positions in cross section. Therefore, the alarm can be informed visually in an easily recognizable manner. Furthermore, the distance H increases between the back cover 17 and the eccentric weight 5*a* contributing to improving the vibration efficiency. If considered based on the structure in the movement, the motor is disposed on the upper side of the main plate 11 and does not protrude downwardly. Therefore, the main plate 11 can be machined easily facilitating the assembling operation.

Figure 12:
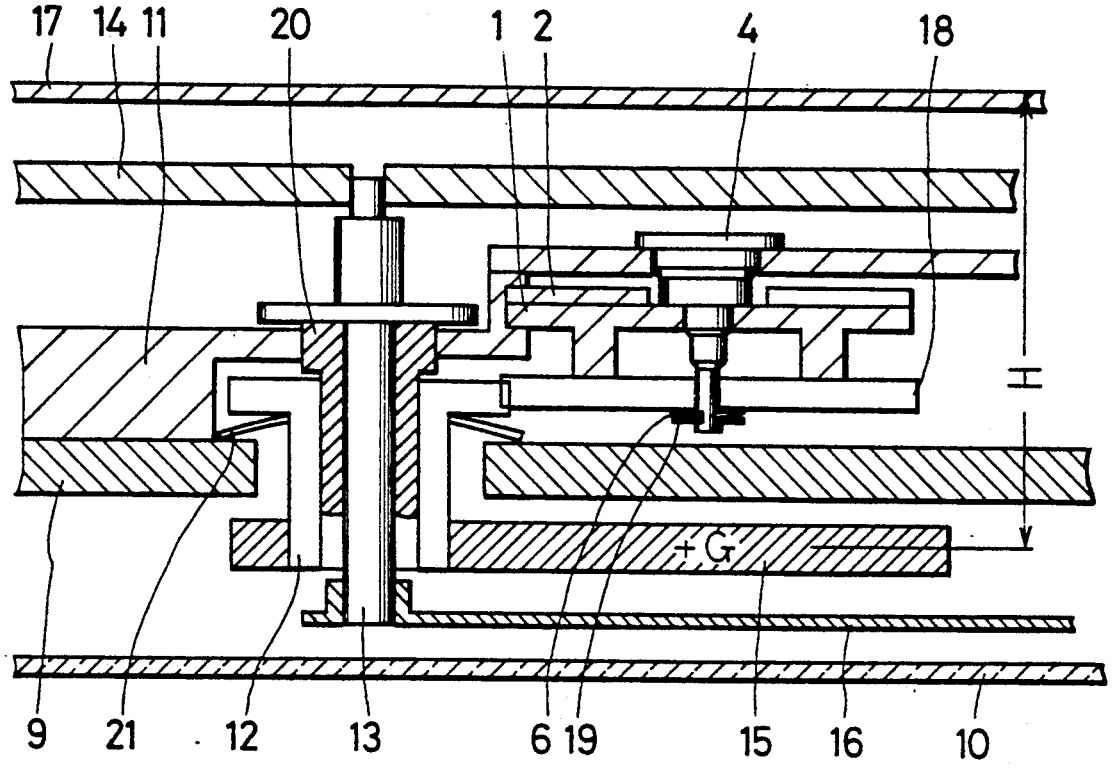
FIG. 12 is a section view of a wrist watch with silent alarm according to another embodiment of the invention.
Figure 13:
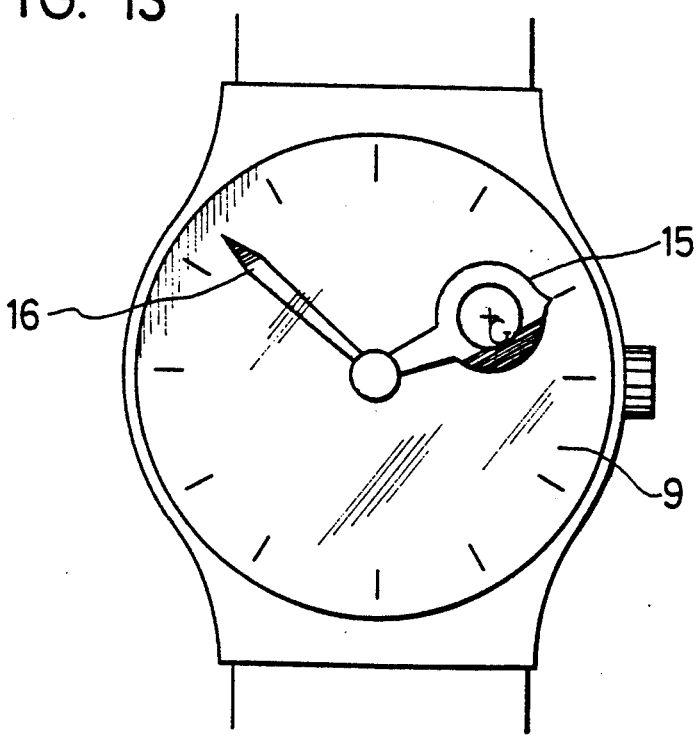
FIG. 13 is a diagram showing the appearance of the wrist watch with silent alarm in FIG. 12.
Figure 14:
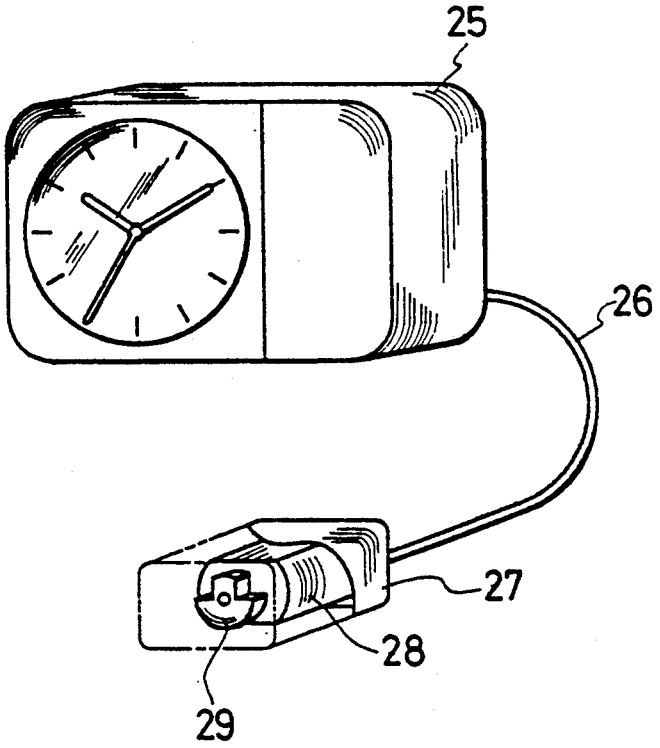
FIG. 14 PRIOR ART
FIG. 14 is a diagram illustrating a conventional example.
Figure 15:
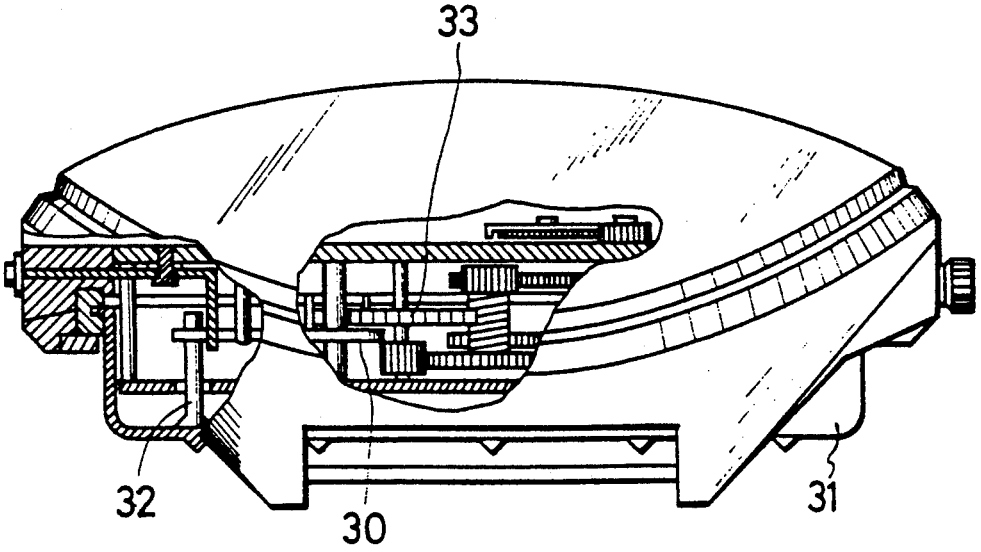
FIG. 15 PRIOR ART
FIG. 15 is a partial section view of another conventional example.

FIGS. 12 and 13 illustrate yet a further embodiment. The hour wheel 12 is in mesh with the rotor 18 of the wave motor that is guided by the pin provided on the main plate 11. The minute wheel 13 is driven by a separately provided motor (not shown) for driving the hands, and the hour wheel 12 and the minute wheel 13 are driven independently of each other. The hour hand 15 is attached to the tip of the hour wheel 12 and has such a shape on a plane that the center of gravity exists at a position G deviated from the axis of rotation as shown, for example, in FIG. 9, in order to produce the effect of an eccentric weight. Usually, therefore, the time is indicated by the tip of the hour hand 15. When the alarm set point time is reached, revolution starts at high speeds to generate vibration which informs the alarm. After the alarm is informed, the position for indicating the time is resumed. In this case, large amounts of energy are required to drive the hour hand that has a large moment of inertia. From the viewpoint of construction, however, the number of parts can be decreased and the thickness of the timepiece can be greatly decreased, too. It need not be pointed out that it is also allowable to employ an ordinary hour hand 15 and a minute hand 16 which has a function of eccentric weight, though not diagramed.

According to this invention as explained in the foregoing, the eccentric weight wheel is driven by the vibration of the vibrator on which a piezoelectric element is adhered, and the whole timepiece is vibrated by the unbalanced centrifugal force produced by the turn of the rotor. Therefore, a wrist watch with silent alarm is realized in a simplified structure having a small size and a reduced thickness. Moreover, the number of parts is decreased to decrease the manufacturing cost. Furthermore, the rotary shaft of the eccentric weight penetrates through the dial and the eccentric weight is disposed on the front side of the dial making it possible to transmit energy of vibration as much as possible to the wrist with a small amount of drive energy. Furthermore, the alarm can be visually informed enabling the wrist watch with silent alarm to exhibit greatly improved ability for letting a person know a set point time.

It is preferred that the electric silent alarm apparatus is constructed in credit card size form to be carried in the pocket instead of a wrist watch form.

While the invention has been particularly shown and described with reference to preferred embodiments thereof, it will be understood by those skilled in the art that various changes in form and details may be made therein without departing from the spirit and scope of the invention.

What is claimed is:

1. An electronic apparatus having a timekeeping function comprising:

a case capable of being held on the palm of a user's hand; timecounting means in said cases for counting a present time;

alarm time setting means for setting an alarm time in response to a user operation;

an ultrasonic motor in said case and having an eccentric weight for generating a vibration;

alarm time detection means for detecting a coincidence of the present time with the alarm time set by said alarm time setting means; and driving means for driving said ultrasonic motor in accordance with said detection of the coincidence.

2. An electronic apparatus claimed in claim 1 wherein said case has a shape of a wrist watch.

3. An electronic apparatus claimed in claim 2 wherein said case includes a pin therein, and said ultrasonic motor includes a vibrator supported by said pin and having a piezoelectric element bonded thereon for generating a surface wave thereon, and an eccentric weight wheel having its center of gravity deviated from its rotational axis and driven by said surface wave.

4. An electric apparatus as claimed in claim 3 wherein said case includes a main plate therein and said pin is fixed in the main plate.

5. An electric apparatus as claimed in claim 3 wherein said eccentric weight wheel is supported by said pin.

6. An electric apparatus as claimed in claim 5 wherein said eccentric weight wheel is in contact with said vibrator.

7. An electric apparatus as claimed in claim 6 including pressurizing means for urging said eccentric weight wheel against said vibrator.

8. An electric apparatus as claimed in claim 3 including a rotor in contact with said vibrator and being rotated by said surface wave.

9. An electric apparatus as claimed in claim 8 including means for effecting rotation of said eccentric weight by said rotor.

10. An electric apparatus as claimed in claim 3 wherein said case includes a glass and a back cover, and said eccentric weight wheel is disposed toward said glass and said vibrator of the ultrasonic motor is disposed toward said back cover.

11. An electric apparatus as claimed in claim 10 wherein said case includes a display portion, and a portion of said eccentric weight is exposed through said display portion.

* * * * *